US005317891A

United States Patent [19]

Ballard et al.

[11] Patent Number: 5,317,891

[45] Date of Patent: Jun. 7, 1994

[54] FREE STANDING PULL TOWER

[75] Inventors: James G. Ballard, Waukesha; Craig A. Wisner, Wauwatosa, both of Wis.

[73] Assignee: Hein-Werner Corporation, Waukesha, Wis.

[21] Appl. No.: 887,467

[22] Filed: May 22, 1992

Related U.S. Application Data

[60] Continuation-in-part of Ser. No. 806,722, Dec. 12, 1991, Pat. No. 5,146,775, which is a division of Ser. No. 619,257, Nov. 28, 1990, Pat. No. 5,111,680.

[51] Int. Cl.[5] ..... B21D 1/12

[52] U.S. Cl. ..... 72/447; 72/705

[58] Field of Search ..... 72/447, 457, 705

[56] References Cited

U.S. PATENT DOCUMENTS 3,492,855 2/1970 Wylie ..... 72/705

3,583,203 6/1971 Williams et al. ..... 72/705

3,754,432 8/1973 Hagerty ..... 72/705

4,175,420 11/1979 Kuhn ..... 72/705

4,712,417 12/1987 Jarman et al. ..... 72/705

*Primary Examiner*—Lowell A. Larson

*Attorney, Agent, or Firm*—Foley & Lardner

[57] ABSTRACT

A free standing rotary tower assembly for applying a force to a damaged part of a vehicle, the assembly including a tower, a support plate mounted on the bottom of the tower, a cylindrical member mounted on the bottom of the plate and a floor mount for supporting the tower assembly, the floor mount including a center plate having a tubular member for matingly engaging the cylindrical member and a number of caster assemblies mounted in the centering plate in a position to engage the support plate when the cylindrical member is aligned with the tubular member.

6 Claims, 7 Drawing Sheets

FREE STANDING PULL TOWER

RELATED APPLICATION

This application is a continuation-in-part of U.S. patent application Ser. No. 07/806,722, filed on Dec. 12, 1991, entitled "Chain Liner" (now U.S. Pat. No. 5,146,775 issued Sep. 15, 1992) which is a division Ser. No. 07/619,257 filed Nov. 28, 1990, now U.S. Pat. No. 5,111,680, issued on May 12, 1992, entitled "Free Floating Tower Assembly For A Damaged Vehicle," and is assigned to the same assignee.

FIELD OF THE INVENTION

This invention relates to vehicle straightening and alignment devices and more particularly to a free standing pull tower for repairing damaged vehicles.

BACKGROUND OF THE INVENTION

Work rack structures of the type contemplated herein are of the type as shown in U.S. Pat. No. 4,313,335, issued on Feb. 2, 1982, entitled "Vehicle Work Rack Structure." This type of a structure is used to correct damaged or misaligned vehicle frames and body parts. Force applying towers are provided around the periphery of the work rack for exerting a pulling force on any damaged portion of the vehicle to correct the damaged condition of the vehicle frame and/or body. The force applying member generally includes a base which is mounted on the work rack and a standard which is secured to the base and projects upwardly from the base. The pulling action is provided by a chain mounted on the tower and connected to a lever arm that is pivoted by a hydraulic piston and cylinder assembly mounted on the back of the tower to apply a pulling action on the chain. The pulling force is applied from fixed points on the tower. This type of equipment lacks mobility and versatility and is difficult to connect in position to provide the proper straightening forces to a damaged member. Also, the space in which such equipment is installed is limited in use only for body and frame straightening activities or other closely associated work.

SUMMARY OF THE PRESENT INVENTION

The free floating tower assembly of the present invention is designed to provide a direct pull from any point on the tower and at any angle from the tower so that the pull is directly in line with the vertical and horizontal planes of the damaged part. It is important particularly in the frame structure that the force be applied in both the horizontal and vertical planes of the damaged part thereby returning the damaged part to the exact position of its original manufacture. The tower assembly is also provided with a unique chain-a-liner assembly which maintains the chain in a straight line at all times thus eliminating jamming o kinking of the chain.

Accordingly, one of the primary features of the free standing pull tower is the ability to position the tower at any position with respect to the damaged vehicle.

A further feature of the invention is the provision of a floor mount which can be anchored to the floor by any of a number of attachments and allows the tower to rotate freely to maintain a straight line relation between the chain on the tower and the damaged part of the vehicle. A principal advantage of the present invention is that it provides wide flexibility of direction in which a control force can be applied to the damaged part of the vehicle.

Other principal features and advantages of the invention will become apparent to those skilled in the art upon review of the following drawings, the detailed description and the appended claims.

DETAILED DESCRIPTION OF THE DRAWINGS

Figure 1:
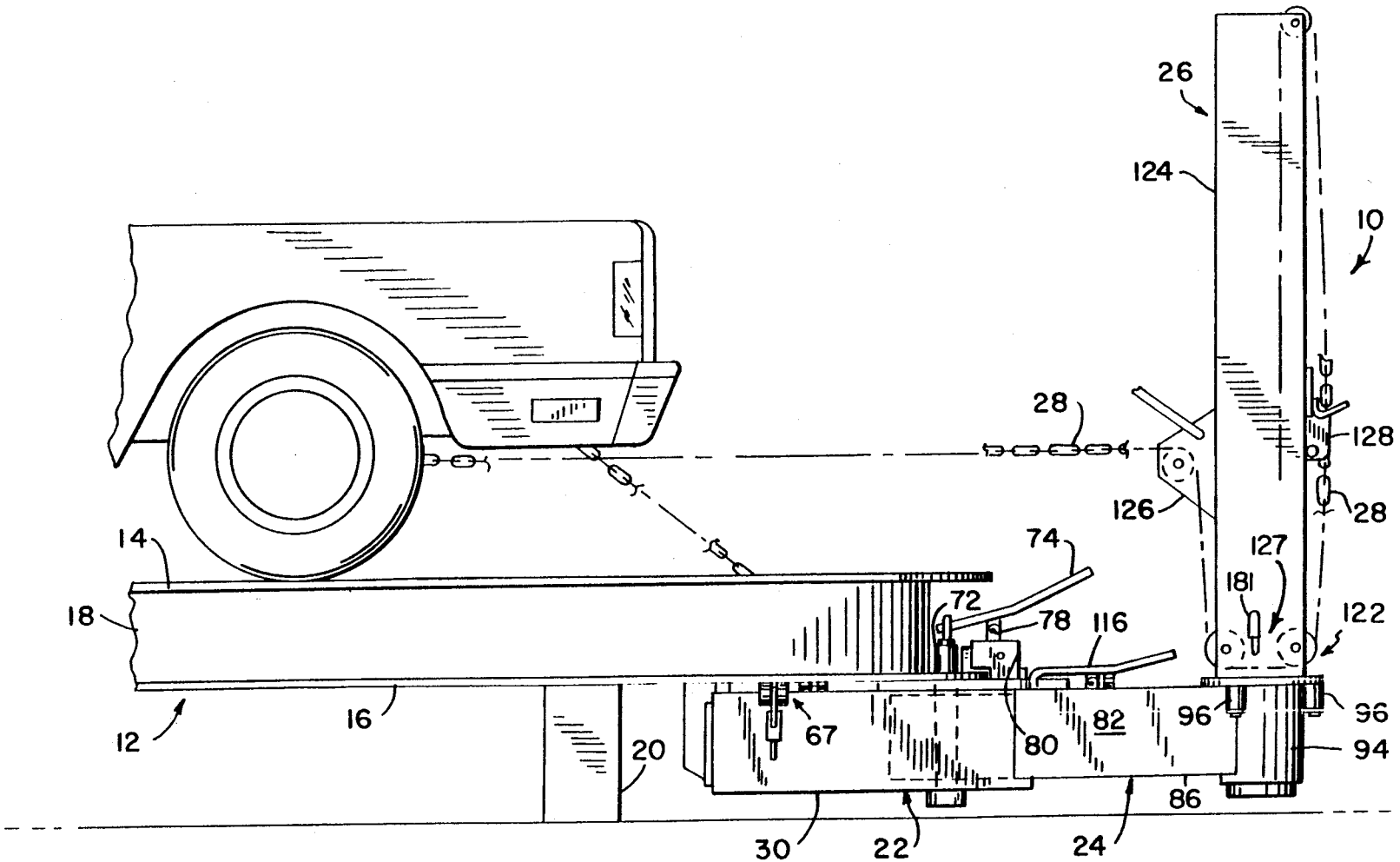
FIG. 1 is a side elevational view of a work rack embodying the present invention.
Figures 2, 6, 7:
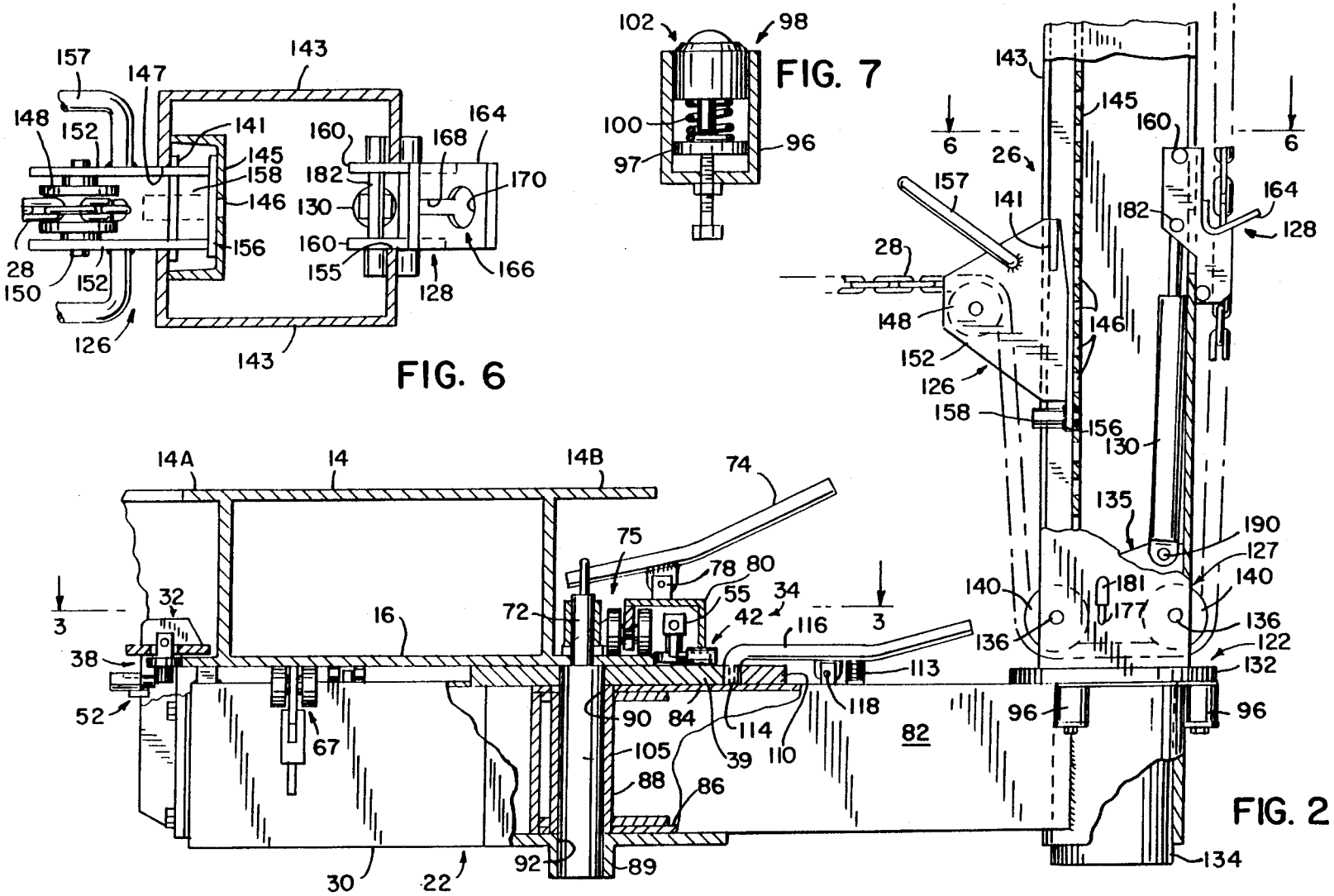
FIG. 2 is a view partly in section of the floating tower assembly shown mounted on the bottom plate of the work rack.
FIG. 6 is a view taken on line 6—6 of FIG. 2.
FIG. 7 is a view partly in section of the caster roller assembly.
Figure 3:
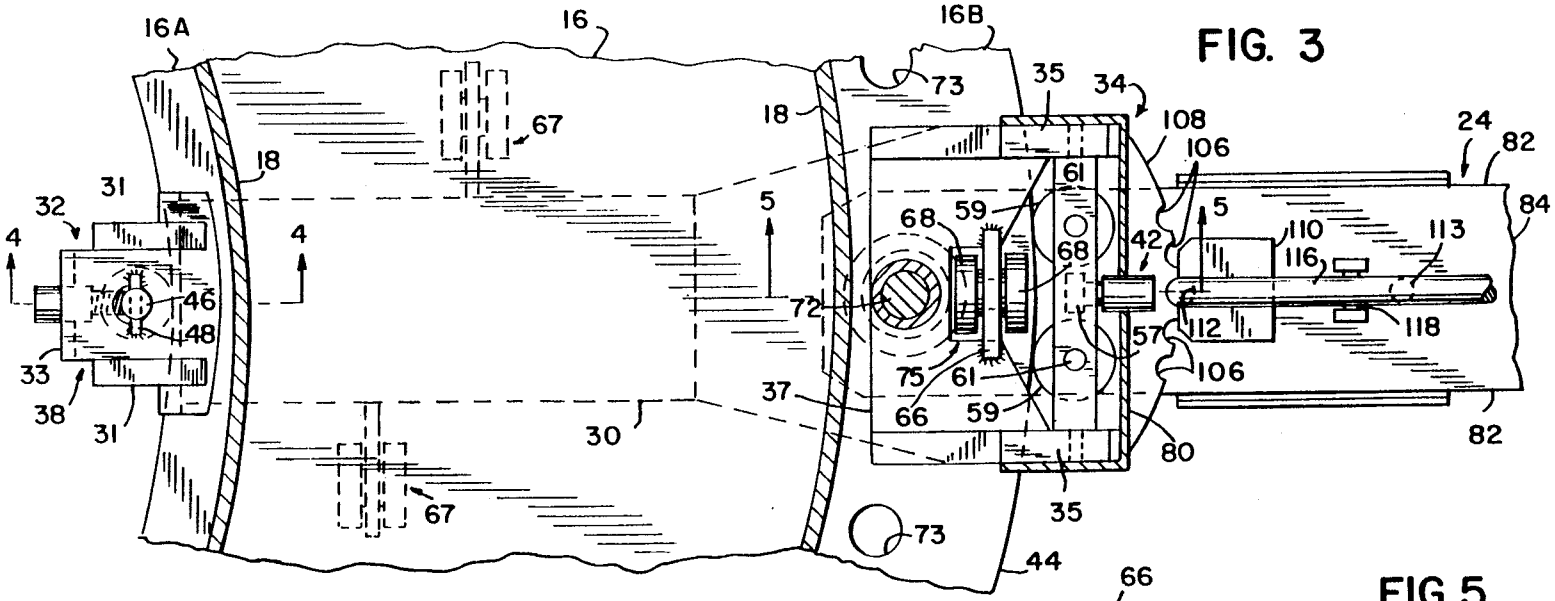
FIG. 3 is a side sectional view taken on line 3—3 of FIG. 2.
Figure 5:
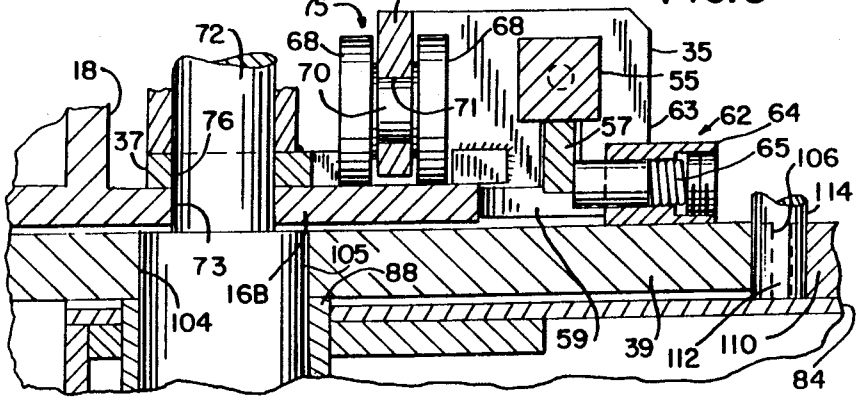
FIG. 5 is a view taken on line 5—5 of FIG. 3.
Figure 4:
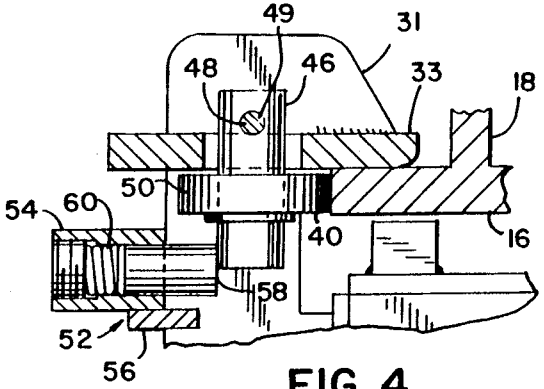
FIG. 4 is a view taken on line 4—4 of FIG. 3.
Figure 9:
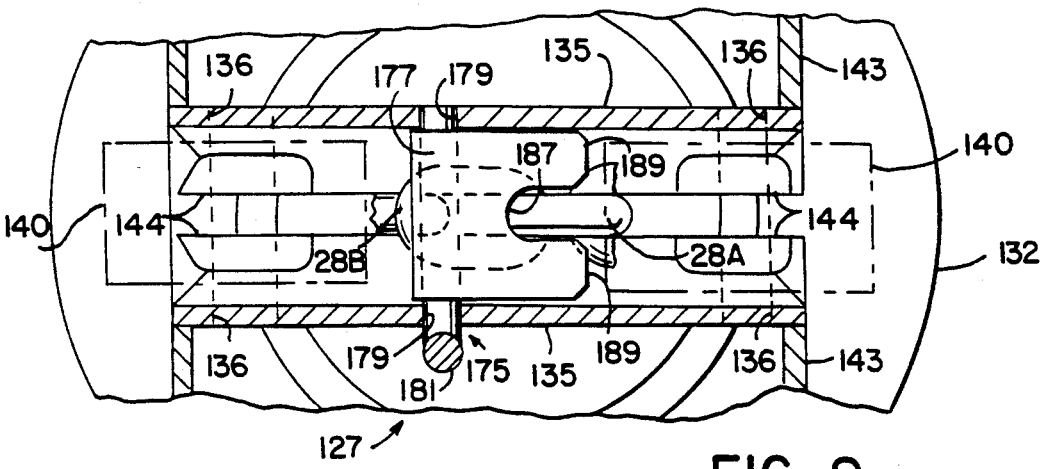
FIG. 9 is a partial top view of FIG. 8.
Figure 8:
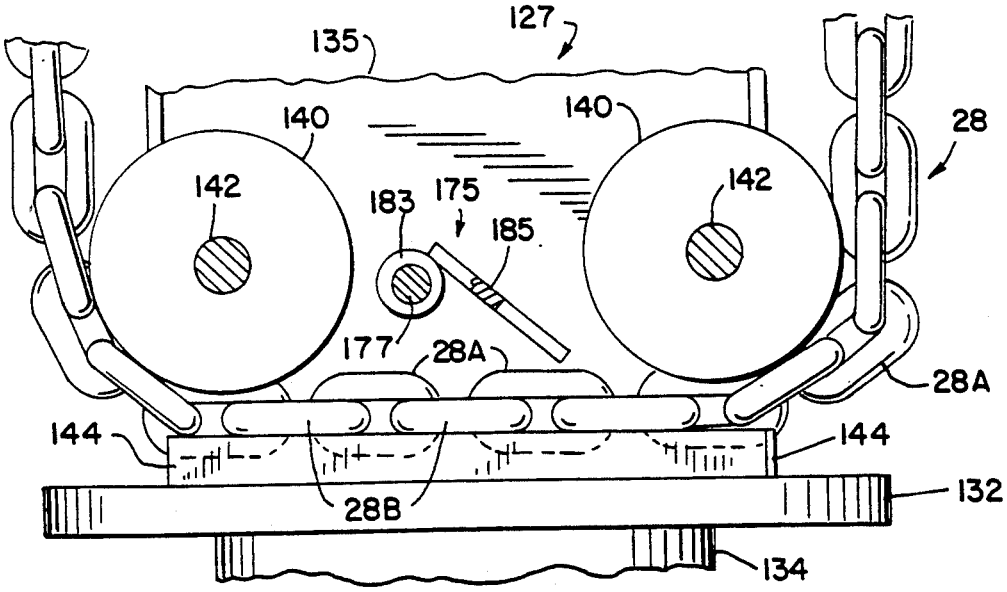
FIG. 8 is a side elevation view of the chain-a-liner.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The free floating tower assembly 10 as shown in FIG. 1 is mounted on a work rack 12 for connection to the damaged area of a vehicle. The work rack 12 generally includes an upper plate 14 and a lower plate 16 which are connected by webs 18 which support the plates 14, 16 in a parallel spaced relation. The webs 18 are spaced inwardly to provide an inner flange A and an outer flange B on each of the plates 14 and 16. The rack 12 is supported on the floor by legs 20.

The tower assembly 10 generally includes a carriage 22 which is mounted on the lower plate 16 and supports a beam 24 which is pivotally movable with respect to the carriage 22. A tower 26 is pivotally mounted on the end of the beam 24. A chain 28 is mounted on the tower 26 and connected to the damaged area of a vehicle. As is generally understood in the art, the chain 28 is placed in tension to pull the damaged part back to its original shape. In order to achieve an accurate return of the damaged part to its original shape, the tower 26 must be aligned as close as possible to both the vertical plane and the horizontal plane of the original part. As the chain 28 pulls the part back to its original position, the tower 26 is free to pivot into alignment with the vertical plane of the original part as the part is pulled toward its original shape.

Carriage

The carriage 22 includes a base beam 30 having an inner hook assembly 32 on the inner end of the member 30 and an outer hook assembly 34 on the outer end of member 30. The inner hook assembly 32 includes a pair of side plates 31 which support a plate 33 that overlies the inner flange 16A. The outer hook assembly 34 includes a pair of side plates 35 mounted on a base plate 39 and supports a plate 37 that overlies the outer flange 16B of the lower plate 16. A wheel assembly 38 is mounted on the inner hook assembly 32 in a position to engage the edge 40 of the inner flange 16A. A wheel assembly 42 is mounted on the outer hook assembly 34 in a position to engage the outer edge 44 of outer flange 16B.

In this regard, the wheel assembly 38 includes a shaft 46 which is aligned with a hole 48 in plate 33. The shaft 46 is supported in the hole by a pin 49. A roller bearing 50 is mounted on the shaft 46 in a position to engage the edge 40 of the inner flange 16A. The roller bearing 50 is biased into engagement with the edge 40 of the inner flange by means of a spring assembly 52 mounted in a housing 54 which is secured to a bar 56. The spring assembly 52 includes a plunger 58 that is positioned to engage the end of shaft 46. The plunger 58 is biased by a spring 60 in housing 54 into engagement with shaft 46. The wheel 50 will follow the contour of the edge 40 of flange 16A.

The wheel assembly 42 includes a crossbar 55 which is pivotally mounted between side plates 35. A pair of roller bearings 59 are mounted on shafts 61 on crossbar 55 in a position to engage the edge 44 of the outer flange 16B. The roller bearings 59 are biased into engagement with the edge 44 of outer flange 16B by a spring assembly 62 mounted in housing 64 on base plate 39. The spring assembly 62 includes a plunger 63 and a spring 65. The plunger 63 is positioned to engage a tab 57 on crossbar 55 to bias the roller bearings 59 into engagement with flange 16B. It should be noted that the roller bearings 50 and 59 are arranged in opposition to each other to center the carriage 22 on the lower plate 16.

The carriage 22 is supported on the lower plate 16 by means of a roller bearing assembly 75 which rides on the upper surface of the outer flange 16B and a pair of roller bearing assemblies 67 mounted on each side of the beam 30 in a position to engage the bottom of the tower plate 16. The assembly 75 is mounted on a vertical plate 66 which is secured to the plate 37. The roller bearing assembly 75 includes a pair of roller bearings 68 which are mounted on an axle 70 which is mounted in a hole 71 in plate 66. The hole 71 is slightly larger than axle 70 so that the roller bearings 68 are free to ride on the upper surface of flange 16B.

Means are provided on the carriage 22 to positively locate the tower assembly 10 in a fixed position on the rack. Such means is in the form of a plurality of holes 73 provided in an equally spaced relation around the lower flange 16B. A locating pin 72 is supported on the end of a lever arm 74 in alignment with a hole 76 in plate 37. The lever arm 74 is pivotally mounted on a pin 78 mounted on the top of a cover 80. The pin 72 is dropped through a hole 76 in plate 37 into one of the holes 73 in flange 16B to lock the tower assembly 10 to the flange 16B.

Pivot Beam

The pivot beam 24 includes a pair of side plates 82 enclosed at the top by a plate 84 and at the bottom by a plate 86. A hollow tube 88 is provided in the beam 24 which is aligned with holes 90 and 92 in the top plate 84 and bottom plate 86, respectively. A cylindrical member 94 is mounted on one end of the beam 24 to support the tower 26. Three spring cylinders 96 are equally spaced around the periphery of the cylinder 94. A caster assembly 98 is housed in each cylinder 96. Each caster assembly 98 includes a spring 100 and a ball caster 102 which projects above the top of cylinder 94. The spring force can be adjusted by a bolt 95 and disc 97.

The beam 24 is mounted in the carriage 22 by aligning the tube 88 with a hole 104 in base plate 39. The hole 104 is aligned with the hole 76 in plate 37. A pin 105 is inserted into tube 88 through a ring 89 on the bottom plate 86 and into the hole 104 in plate 39. The beam 24 is free to pivot with respect to the carriage through an arc of 16°.

Means are provided to locate the beam 24 in a fixed relation to the carriage 22. Such means is in the form of a number of semi-circular notches 106 provided in the edge 108 of plate 39. A plate 110 is provided on the top of plate 84 in abutting relation to the notched edge 108 of plate 39. A semi-circular notch 112 is provided in the edge of plate 110 which forms a circular hole when aligned with one of the notches 106 in the plate 39. The beam is locked to the carriage by a pin 114 which is dropped into the hole formed by the notch 112 and one of the notches 106. The pin 114 is mounted on the end of a lever arm 116 which is pivotally mounted on a shaft 118 on plate 84. The lever 116 is biased to the locked position by a spring 113.

Tower

The tower 26 includes a cylindrical base assembly 122 and a vertical column 124 mounted on the base assembly 122. The chain 28 is aligned with an adjustable bracket 126 mounted on one side of the column 124, a chain-a-liner 127 mounted in the bottom of column 124, and a chain dog 128 mounted on the other side of the column 124. The chain dog 128 is moved vertically on the column by means of a hydraulic piston and cylinder assembly 130 to introduce a pulling force on the chain 28.

The cylindrical base assembly 122 includes a circular plate 132 having a cylindrical base 134 mounted on the bottom and the chain-a-liner 127 mounted on the top. The cylindrical base 134 is concentrically aligned in cylinder 94 with the base plate 132 resting on the caster assemblies 98. The chain-a-liner 127 includes a pair of brackets 135 mounted in a parallel spaced relation on base plate 132. Each bracket 135 includes a hole 136 on each end. A pair of chain sprockets 140 are supported between the brackets 135 by shafts 142 aligned in holes 136. A pair of blocks 144 are positioned below each of the sprockets 140 to maintain the alignment of the chain. The blocks 144 are spaced apart a distance sufficient to allow each vertical or alternate chain link 28A to pass between the blocks 144. The horizontal links 28B slide across the top of the blocks 144. The chain 28 is thus prevented from twisting or kinking as the chain is passed through the tower. A chain lock 175 is provided in the chain-a-liner 127 to hold the chain 28 in tension whenever the hydraulic piston and cylinder 130 has to be retracted. The chain lock 175 includes a pin 177 mounted for pivotal movement in holes 179 in brackets 135. A handle 181 is provided on one end of pin 177. A tube 183 is secured to pin 177 and a plate 185 is secured to the tube 183. The plate 185 includes a slot 187 in one side to define a pair of legs 189. The handle 181 is rotated downward to move the plate 185 into engagement with the chain 28. The legs 189 of the plate 185 will straddle one of the vertical links 28A and will move into engagement with the end of the blocks 144 to hold the chain 28 in tension while the hydraulic cylinder 130 is retracted.

The vertical column 124 is formed by two channel members 143 mounted on the base plate 132 in a spaced relation. A vertical adjustment plate 145 is mounted in a spaced relation to the gap 147 between the channel members 143 on one side of the column 124. A number of equally spaced holes 146 are provided in the plate 145. An upper plate 148 and a lower plate 150 are provided in the space or gap 155 between the channel members 143 on the other side of the columns 124. The vertical adjustment bracket 126 is mounted on the adjustment plate 145 in the gap 147. The chain dog 128 is mounted in the gap 155 between the channel members 143.

The adjustment bracket 126 includes a pair of side plates 152 mounted on a back plate 156. A plate 141 is provided on the outside of each side plate 152 to engage the channel members 143. A pin 158 is mounted on the back plate 156 in a position to engage one of the holes 146 in the plate 145. A chain sprocket 148 is mounted on an axle 150 between the side plates 152. A handle 157 is connected to the side plates 152 for pivoting the bottom of the back plate 156 away from plate 145 to pull the pin 158 out of the hole 146 to allow for vertical adjustment of the bracket.

The chain dog 128 includes a pair of side plates 160 connected to a chain dog plate 164. The plate 164 includes a "key" hole 166 having a slot 168 and a hole 170. The plate 164 is angled upwardly from the side plates 160. A hydraulic piston and cylinder assembly 130 is connected to a pin 182 in the side plates 160 and to a pin 190 in brackets 134. On upward movement of the chain dog 128 one of the links of the chain 28 will drop into the slot 168 locking the chain in the dog plate 164 so that a force is applied to the chain. When the dog 128 is retracted, the plate 164 will cam the chain link out of the slot 168 and into the hole 170, allowing the chain to pass through the hole as the chain dog 128 is retracted.

Free Standing Floating Tower Assembly

Figure 10:
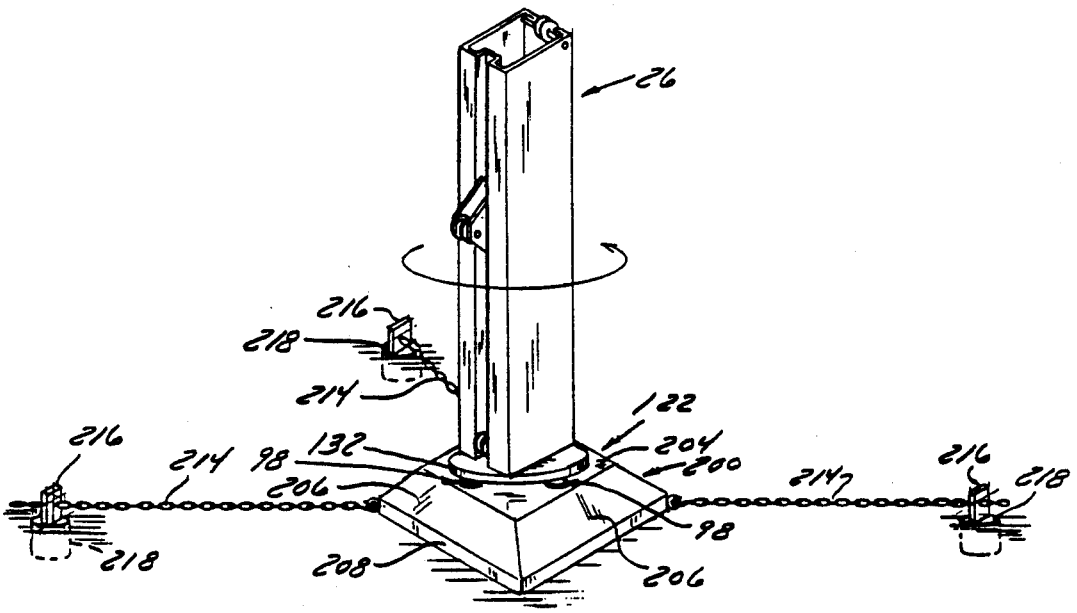
FIG. 10 is a perspective view of one form of hold down assembly for the free floating tower assembly.
Figure 11:
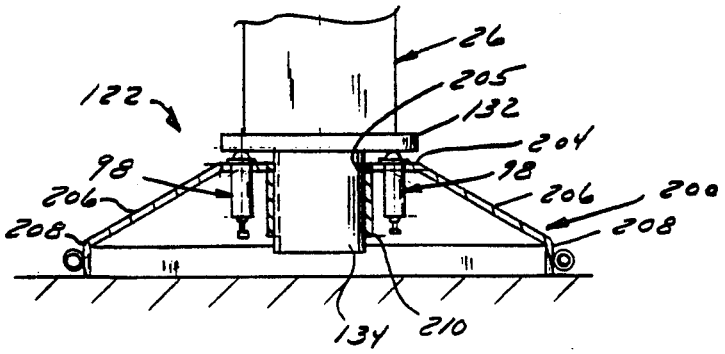
FIG. 11 is a view partly in section showing the ball type caster assembly for supporting the tower assembly of FIG. 10.

Referring to FIGS. 10 and 11 a free standing floor mount 200 is shown for supporting the floating tower 26. As noted above, the base assembly 122 for the tower 26 includes a circular plate 132 having a cylindrical member 134 mounted on the bottom of the plate 132. The floor mount 200 includes a generally square center plate 204 having a circular opening 205. The center plate 204 is supported by angularly offset side walls 206 and a floor frame 208. A tubular member or cylinder 210 is positioned in the opening 205 and depends from the center plate 204. A number of caster assemblies 98, as described above, are mounted in the center plate 204 around the tubular member 210. The tower 26 is mounted on the floor mount 200 by aligning the cylindrical member 134 in the tubular member 210 with the circular plate 132 resting on the caster assemblies 98. The floor mount 200 is secured to the floor by chains 214 which are attached to one or more of the corners of the floor frame 208. Each chain includes a chain anchor 216 at the outer end which is anchored in an anchor pot 218 provided in the floor.

Figure 12:
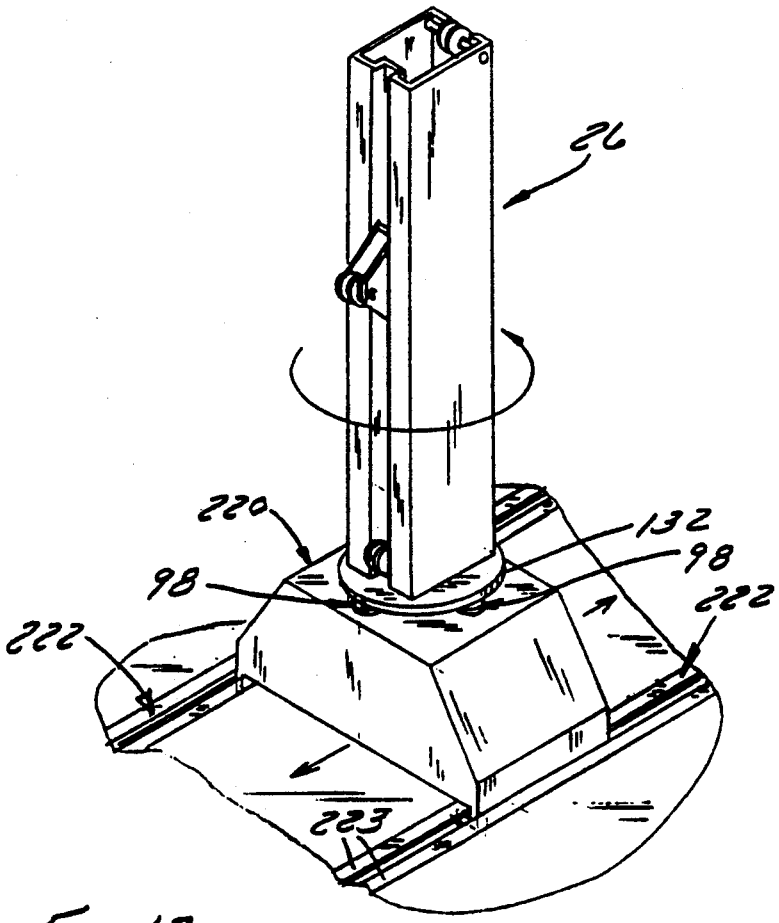
FIG. 12 is a perspective view of another form of hold down assembly for the free floating tower.
Figure 13:
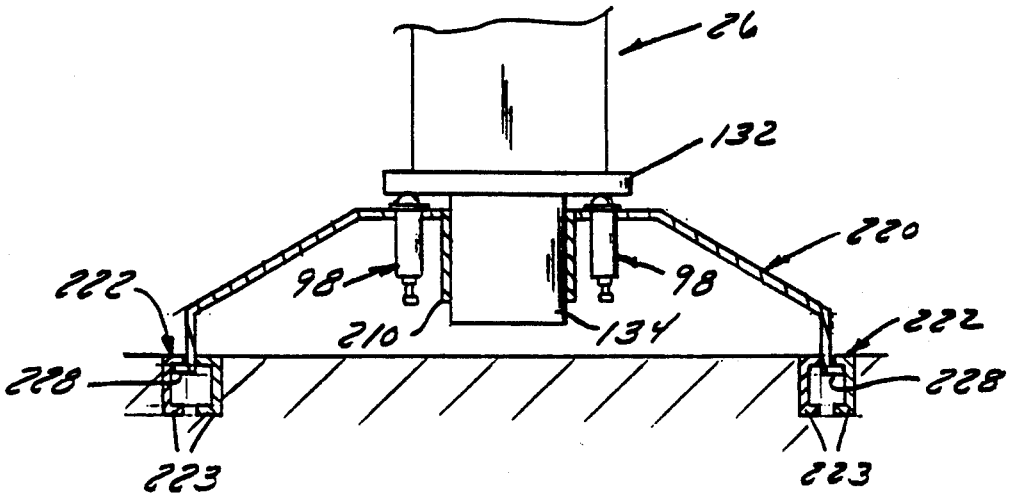
FIG. 13 is a view partly in section of the ball type caster assembly for the second hold down assembly of FIG. 12.

The floor mount 220 shown in FIGS. 12 and 13 is used in conjunction with KOREK TM type rail assemblies 222 which are embedded in the floor. Each KOREK TM type assembly includes a pair of "C" shaped rails 223 which are placed in a face-to-face relation. The base assembly 122 for the tower 26 is aligned with the cylinder 210 and is supported on a set of caster assemblies 98 which are located around the outer perimeter of the cylinder 210 as described above. The floor mount 220 includes a flange 228 along the bottom of two sides of the floor mount 220. Each flange 228 is aligned with the rails 222 to allow the floor mount to be moved in either direction in the rails.

Figure 14:
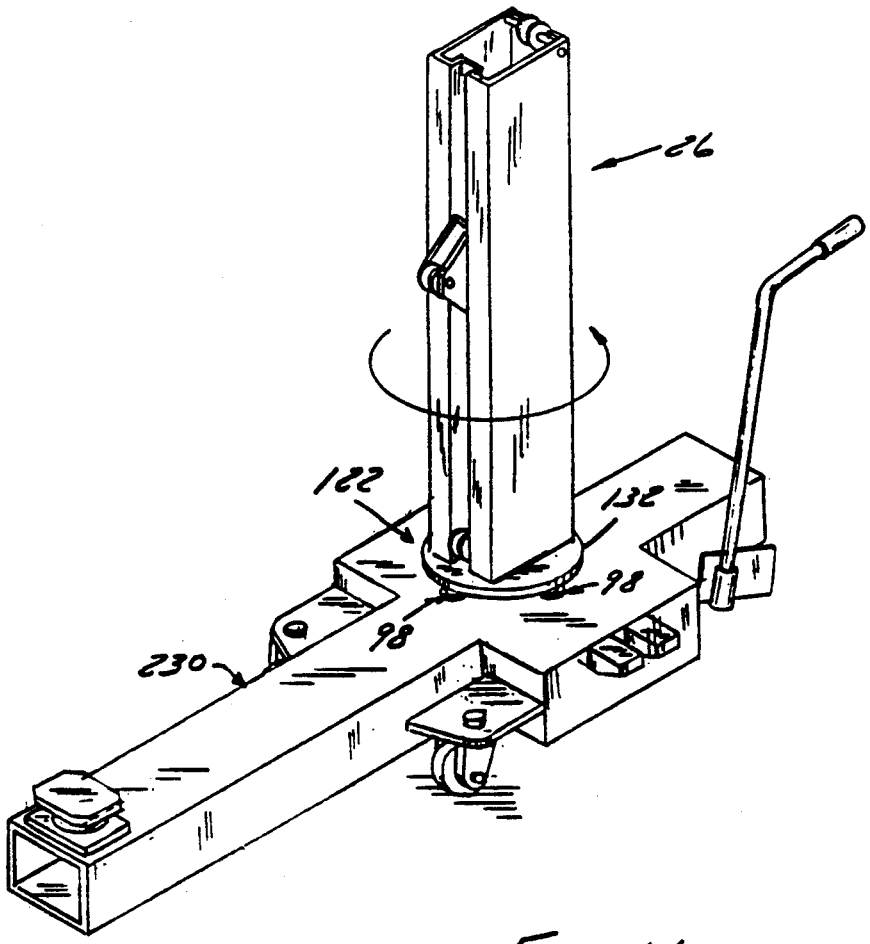
FIG. 14 is a perspective view of the free floating tower supported on a power pulling arm.
Figure 15:
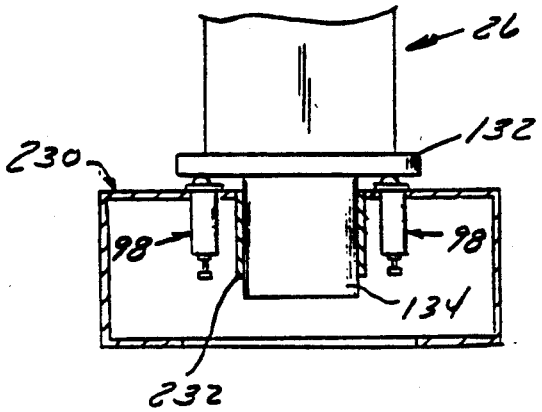
FIG. 15 is a view partly in section of the ball type caster assembly for the hold down assembly of FIG. 14.

In FIGS. 14 and 15 the tower 26 is shown mounted on a POWER PRO TM pulling arm 230 which has been modified to support the base assembly 122 for tower 26. In this regard a tubular member 232 is mounted in the POWER PRO TM with a number of caster assemblies 98 positioned around the perimeter of the tubular member 10. The base assembly 122 on the tower 26 is aligned with tubular member 232 and supported by the caster assemblies 98 as described above.

Thus, it should be apparent that there has been provided in accordance with the present invention a free standing pull tower for a damaged vehicle that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A floor mount for supporting a tower assembly in a position to apply a force to a damaged part of a vehicle, the tower assembly including a tower, a support plate mounted on the bottom of the tower and a cylindrical member mounted on the bottom of the plate, said floor mount including:

a center plate having a centrally positioned tubular member adapted to concentrically engage the cylindrical member and a number of ball caster assemblies mounted on said center plate for supporting said support plate on the tower for rotary motion on said caster assemblies, and means for securing said floor mount to the floor.

2. The mount according to claim 1 wherein said securing means comprises a number of anchor pots mounted in the floor and a set of chains for anchoring said floor mount to the anchor pots in the floor.

3. The mount according to claim 1 wherein said securing means comprises a pair of rails mounted in the floor and a flange mounted on opposite sides of said floor mount for engaging said rails.

4. The assembly according to claim 1 wherein said securing means comprises a power pulling arm assembly having a cylindrical bore and a number of caster assemblies for supporting said tower for rotary motion on said assembly.

5. An apparatus for applying a tensile force to the damaged area of a vehicle body comprising a tower assembly having a chain mounted thereon for attachment to the damaged area of the vehicle body, a base assembly comprising a plate and a cylindrical member mounted on the bottom of the plate with said base assembly for supporting the tower for pivotal motion to the direction of the pull on the chain and a floor assembly comprising a plate having a cylindrical tube matingly engaging said cylinder member and a plurality of caster assemblies mounted on said floor assembly plate for supporting said base assembly for rotary motion on the floor assembly, said floor assembly including means for securing the apparatus to the floor.

6. The apparatus according to claim 5 wherein said securing means comprises a number of chains secured to said floor assembly and an anchor on the end of each of said chains for securing said chains to the floor.

* * * * *